United States Patent [19]

Richardson

[11] Patent Number: 4,498,077

[45] Date of Patent: Feb. 5, 1985

[54] ANNUNCIATOR

[75] Inventor: Patrick L. Richardson, Los Angeles, Calif.

[73] Assignee: Carrier Corporation, Syracuse, N.Y.

[21] Appl. No.: 497,441

[22] Filed: May 23, 1983

[51] Int. Cl.[3] ..... G08B 21/00

[52] U.S. Cl. ..... 340/648; 337/79; 340/644; 340/652; 340/664; 361/23

[58] Field of Search ..... 340/648, 652, 644, 654, 340/660, 664; 337/79, 241, 242, 265, 266, 332, 376; 361/23, 100

[56] References Cited

U.S. PATENT DOCUMENTS

| | | | |
|---|---|---|---|
| 2,614,160 | 10/1952 | Foote et al. | 340/652 X |
| 3,548,399 | 12/1970 | Monigal et al. | 340/644 X |
| 3,611,036 | 10/1971 | Edson | 340/648 X |
| 3,611,364 | 10/1971 | Jones | 340/644 X |
| 3,696,364 | 10/1972 | Lavelle | 340/644 X |
| 3,840,780 | 10/1974 | Sons | 340/648 X |
| 3,854,089 | 12/1974 | Emler | 340/654 X |
| 4,247,849 | 1/1981 | Morris et al. | 340/660 |
| 4,390,870 | 6/1983 | Michael | 340/648 |

OTHER PUBLICATIONS

Devices for Liquid Level Indication and/or Control, FEA Devices, Inc., Santa Cruz, Calif.

Opto Coupler, Photo Triac Driver Output, Motorola, Inc., 1949.

*Primary Examiner*—James L. Rowland

*Assistant Examiner*—Daniel Myer

*Attorney, Agent, or Firm*—David J. Zobkiw

[57] ABSTRACT

An indicator is provided for each of a number of preselected conditions and is actuated in response to the occurrence of the corresponding condition. The indicator remains actuated until manually reset even if the triggering condition no longer exists.

4 Claims, 2 Drawing Figures

ANNUNCIATOR

BACKGROUND OF THE INVENTION

In transporting perishable cargo, it is necessary to keep the cargo temperature controlled during the entire trip. Where, for example, a diesel engine is the power source for the refrigeration system, the diesel engine has the potential of incurring the same problems and difficulties of any diesel prime mover engine, such as overheating and lack of lubrication. Similarly, the refrigeration and heating system is subject to mechanical and electrical malfunction. Normally, in engine driven applications, indicator or "idiot" lights are used to monitor these conditions, but in the case of transport refrigeration equipment such as tractor-trailers, these lights are of limited value since the driver is remote and could be away from the equipment for extended periods of time. Since there is a high probability that no one will be in a position to heed a light's warning to shut down the equipment before major damage occurs, it is therefore common practice to eliminate these optical indicators and shut down the engine automatically in response to the sensing of an abnormal condition. The usual way to achieve shutdown to protect an engine in this type of application is to utilize electromechanical switches, commonly referred to as "safety switches", positioned on the engine, each sensing a particular problem. If a problem occurs, the appropriate switch opens and the engine is shut down.

The dilemma with this approach is that although the equipment is protected there often is no immediate way of discerning the reason for the shutdown. By the time an operator/driver discovers the shutdown, the water may have cooled, refrigerant pressure may have equalized or an electrical overload may have abated. Since a safety switch resets automatically, it is difficult or even impossible to pinpoint the instant problem.

SUMMARY OF THE INVENTION

With escalating labor costs, trouble shooting of a mobile refrigeration unit has taken on increased importance. Further, with the trend to utilize trailers on board rail cars where unattended operation is extended for long periods of time, the need exists to have a method of indicating a malfunction. Normal procedures cannot be used for ascertaining such failures as sufficient time has usually elapsed to shroud the obvious logic.

It is therefore the primary object of this invention to overcome this problem by providing an annunciator having a persistent indication of the cause of such malfunction with such continual designation until manually reset. This is accomplished utilizing an optical coupler in the form of an optically isolated triac driver consisting of a gallium-arsenide infrared emitting diode optically coupled to a silicon bilateral switch. The refrigeration unit safety switch is connected in parallel to the diode circuit with higher resistance through this circuit. During normal operation, with the contacts of the safety switch closed, no energy is passed through the coupler. However, upon opening of the safety switch, when a malfunction occurs, this alternative path is provided.

The infrared emitting diode is energized providing an optical path to the silicon bilateral switch. Since the two inherent systems are isolated, the switch is triggered by a triac circuit sensitive to the infrared signal. The low current isolated switch of the coupler provides a path for low voltage, direct current power to be attached to a light emitting diode thus providing a visual signal of failure mode. Inherent in this coupler is a latching arrangement allowing the circuit to remain closed in the bilateral switch until the external circuit is opened by a manually actuated, single pole, single throw, normally closed push button switch.

Another object allows the invention to be selective in the indication of the failure where at least two safety switches cause the same resultant shutdown of the engine of a refrigeration system. The initial method is as described above, however, two couplers are connected in series on the infrared emitting diode side. A transistor is introduced into the circuit bypassing one of the couplers when its safety switch is actuated. Further, the transistor isolates the coupler when the corresponding safety device is energized allowing the LED to indicate the appropriate failure.

Yet another object provides a novel feature eliminating the indication of a failure when the engine of a refrigeration unit initially starts. Normally, the contacts of an oil pressure safety switch are open prior to building up pressure in the crankcase. This feature is provided by the use of a transistor driven by an RC network creating a time delay of perhaps less than one second. This transistor is laterally joined to the appropriate coupler on the diode side providing a path to ground during this time interval.

These and other objects and advantages of the present invention will become apparent from the subsequent detailed description of the preferred embodiment and the appended claims.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENT

Figure 1:
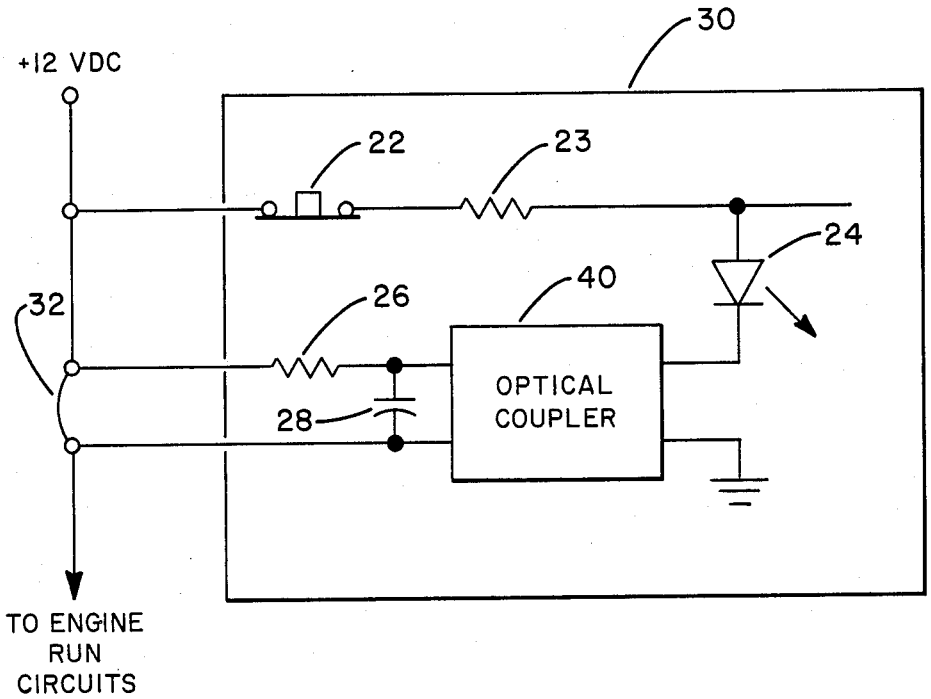
FIG. 1 is a schematic diagram of a typical portion of the annunciator circuit.
Figure 2:
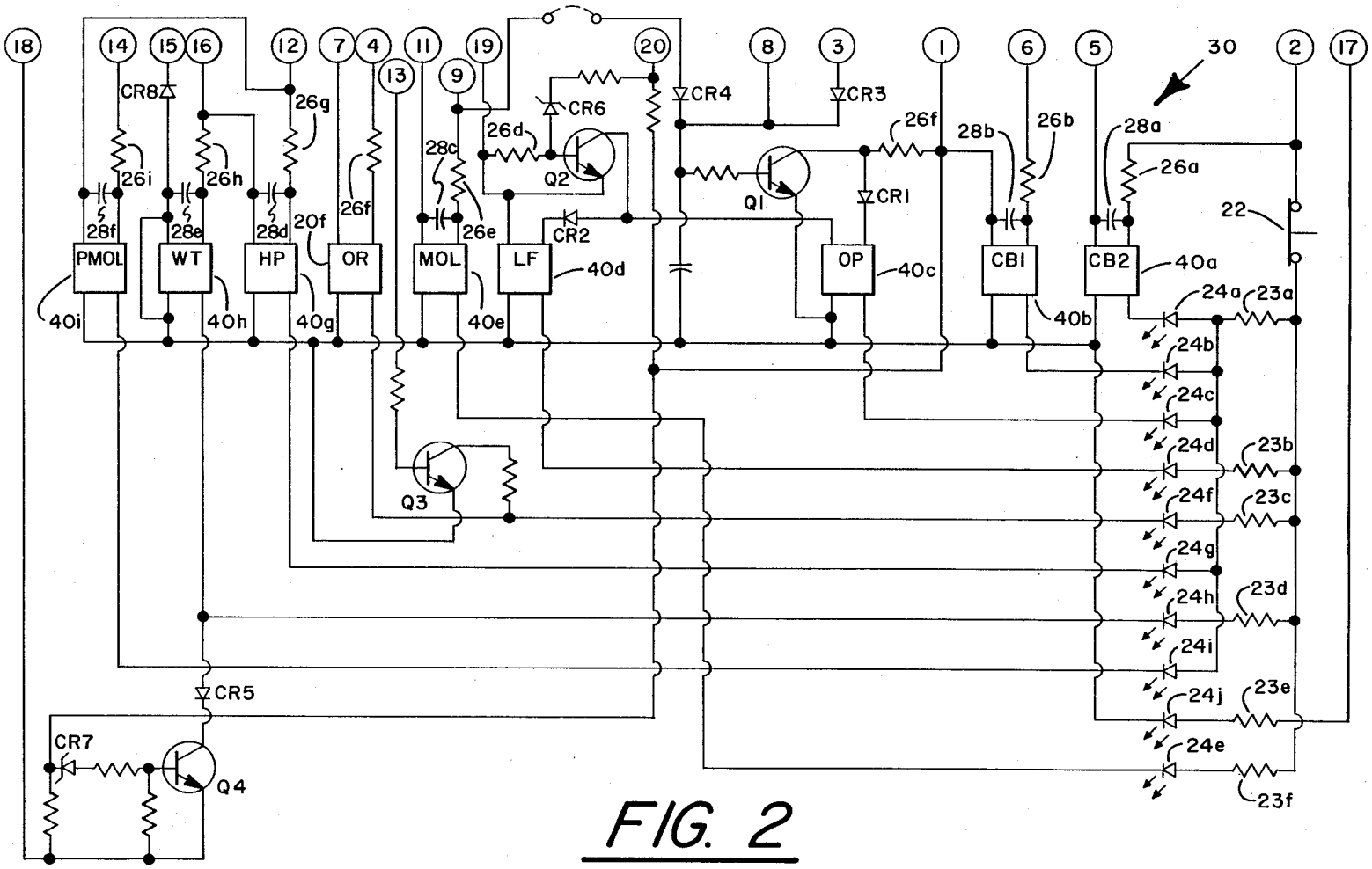
FIG. 2 is a schematic diagram of the complete annunciator circuit.

In FIGS. 1 and 2, the numeral 30 generally designates an annunciator. The annunciator 30 contains circuitry which, in effect, provides a light emitting diode or LED 24 connected to safety switches and circuit breakers via an optical coupler 40 in a refrigeration or air conditioning system. Referring specifically to FIG. 1, a safety switch 32 is in the power feed to the engine run circuits and is opened in response to a system overload or the like. Switch 32 is an electromechanical device which resets automatically and is a standard feature in refrigeration and air conditioning systems. When safety switch 32 is closed, it provides a shunt relative to the circuitry of the annunciator 30. Upon the opening of switch 32 the engine stops running and optical coupler 40 is connected, through dropping resistor 26, across switch 32 and in parallel with capacitor 28 which prevents nuisance trips and suppresses unwanted noise on the input side of the electrical network. Optical coupler 40 contains an internal infrared emitting diode which is now in a series path and is optically coupled to a silicon bilateral switch which then provides an electrical path through dropping resistor 23, which reduces the voltage potential, to LED 24 and to ground. Optical coupler 40 is preferably a MOC3011 opto coupler with a photo triac driver output which is manufactured by Motorola Inc. of Phoenix, Ariz. This opto coupler is normally used to drive an AC power circuit rather than a DC circuit as in the present invention. Thus, when safety switch 32 opens and places normally closed, manually actuated switch 22, dropping resistor 23 and LED 24 in a complete circuit to ground through optical coupler 40, a circuit is established which will persist even if switch 32 is reset. The reason that this circuit will be established upon the opening of switch 32 and will persist upon its reclosing to keep LED 24 lit is that when switch 32 is initially closed, the parallel path through the optical coupler 40 is of too high of a resistence to power its internal infrared emitting diode. However, when switch 32 opens, the breaking of the parallel path puts optical coupler 40 in a series circuit and sufficient current flows to power the internal infrared emitting diode triac triggering the electrically isolated silicon bilateral switch thereby completing a circuit causing LED 24 to light. The regenerative action of the triac in the optical coupler 40, when stimulated by infrared radiation, causes the triac to turn on and latch allowing the LED 24 to be energized even if switch 32 is subsequently closed. Thus, once LED 24 is lit, it will remain lit until switch 22 is manually opened to break the circuit or the source of electrical power is removed.

In FIG. 2, the circuit of FIG. 1 has been expanded to include the balance of the circuitry of the annunciator 30. Annunciator 30 has nine optical couplers, 40*a–i*, which are the same as the optical coupler 40 illustrated in FIG. 1, except they have been labeled according to the condition to which they are responsive. Couplers 40*a–i* are responsive to the following safety switches: circuit breakers (CB2 and CB1), oil pressure (OP), low fuel (LF), motor overload (MOL), out of temperature range (OR), high pressure (HP), water temperature (WT) and permanent magnet generator overload (PMOL). Other sensed conditions and configurations may be employed, as for example, coupler 40*a* may detect internal protection for the compressor (IPC), coupler 40*g* may detect condenser motor overload (COL), coupler 40*h* may detect evaporator motor overload (EOL) and coupler 40*i* may detect high pressure (HP). Dropping resistors 23*a–f* and 26*a–i* correspond to and function the same as dropping resistors 23 and 26 of FIG. 1. Similarly, capacitors 28*a–f* function the same as capacitor 28 of FIG. 1. LEDs 24*a–i* are in circuits with couplers 40*a–i*, respectively. LED 24*j* is connected to ground via terminal 17 indicating that one of the safety switches or circuit breakers has opened. It is obvious from FIG. 2 that couplers 40*a, b, e, f, g* and *i* are coupled and perform as described with respect to FIG. 1.

Because coupler 40*c* does not distinguish the ultimate reason for low oil pressure, it is placed in series with coupler 40*d* which is responsive to low fuel which may also be the source of the low oil pressure. The oil pressure switch is coupled between terminals 1 and 19 and the low fuel sensor is connected to terminal 20. If the oil pressure switch contacts open due to a mechanical aberration the current path is to the first path of coupler 40*c* with the second path in series with coupler 40*d* and also transistor Q2. If a condition of low fuel exists, as sensed by a solid state device located within the fuel system, power is transmitted to transistor Q2. This condition creates a resistance allowing the flow to be directed to coupler 40*d* energizing the low fuel indicating LED 24*d* and also LED 24*c* designating both conditions of malfunction. If the fuel sensor is open the transistor Q2 allows the power to bypass coupler 40*d* and only LED 24*c*, indicating low oil pressure, is energized. Conversely, if transistor Q2 is energized, flow from the low fuel sensor switch is directed through the transistor Q2 directly to the coupler 40*d* and its corresponding LED 24*d*. Thus the transistor Q2 isolates the coupler when the corresponding safety device is energized allowing the LED to indicate the appropriate failure or combination thereof.

The out-of-range temperature signal is received at terminal 13 which is connected to transistor Q3, as is conventional, as well as to coupler 40*f*. The low water sensor is connected to terminal 18 and is connected to the water temperature coupler 40*h* through transistor Q4, rectifier diode CR5 and voltage regulator CR7 to allow the LED 24*h* to be responsive to either a low water level or too high of an engine temperature.

In order to eliminate the indication of a failure when the engine of a refrigeration unit first starts, prior to building up oil pressure within the crankcase, a transistor Q1 is utilized in conjunction with an RC network. This allows a time delay of perhaps 0.5 seconds providing the manual switching arrangement on the refrigeration unit to physically bypass the indication system precluding an erroneous visual signal.

From the foregoing, it is obvious that the present invention provides a persistent indication of the cause of a shutdown and where necessary provides an unambiguous cause for shutdown. The transistors Q1–Q4 may be model 3904 manufactured by Motorola; rectifier diodes CR1 and 2 may be model IN4148 manufactured by Motorola; rectifier diodes CR3–5 and 8 may be model IN4005 manufactured by Motorola; voltage regulator diodes CR6 and 7 may be model IN5234B manufactured by Motorola; and a suitable liquid level sensor is manufactured by FEA Devices Inc. of Santa Cruz, Calif.

In summary, the opening of a circuit breaker or a safety switch causes the actuation of an optical coupler establishing an electrical circuit containing an LED identified with that switch or circuit breaker. Because the optical coupler changed the latched on state of an internal silicon bilateral switch completing the electrical path through the LED, the circuit persists even upon the closing of the safety switch or circuit breaker. Additionally, where an ambiguous indication is possible, plural LEDs may be connected to resolve the ambiguity.

Although a preferred embodiment of the present invention has been illustrated and described, other changes will occur to those skilled in the art. It is therefore intended that the scope of the present invention is to be limited only by the scope of the appended claims.

What is claimed is:

1. Apparatus for providing a persistent indication of the cause of an engine failure/shutdown in an engine having a source of electrical power and a first electrical path containing a plurality of engine safety devices each having a normally closed position in which electric power is conducted and an open position in which the passage of electrical power is blocked comprising:

a normally closed, manually actuated switch means adapted to be connected to the source of electrical power;

a plurality of LED means;

a plurality of optical coupler means each of which has two electrical paths a first one of which is adapted to be connected across one of said engine safety devices and to the source of electrical power to establish a parallel electrical path across the respective engine safety device with the parallel electrical path being shunted when the respective engine safety device is in the closed position; and circuit means for forming a second electrical path between said switch means and ground and including a plurality of branches each defining an electrical path each of which includes one of said plurality of LED means and a second one of said two electrical paths of one of said plurality of optical coupler means whereby the opening of an engine safety device removes the shunt across said first one of the two electrical paths of the corresponding optical coupler means causing actuation of said corresponding one of said optical coupler means which causes the completion of a circuit containing the corresponding second one of said two electrical paths and the corresponding LED means which lights and remains lit until said switch means are opened.

2. The apparatus of claim 1 further including second circuit means connecting two of said coupler means whereby each of the corresponding LED means can be lit individually and at the same time.

3. The apparatus of claim 2 wherein said second circuit means connecting said two coupler means includes transistor means.

4. A method for providing a persistent indication of the cause of an engine failure/shutdown upon the opening of an engine safety device comprising the steps of:

monitoring each of a number of operating conditions of an engine;

opening a circuit element responsive to each of the corresponding operating conditions reaching a predetermined level to thereby shut down the engine;

providing a parallel path containing an optical coupler across each openable circuit element such that the parallel path is normally shunted;

enabling the corresponding optical coupler upon the opening of the circuit element;

actuating a corresponding indicator in an optically coupled circuit when each of the optical couplers is enabled; and maintaining the corresponding indicator actuated upon the closing of the opened circuit element.

* * * * *